United States Patent [19]

Gibson

[11] Patent Number: 4,720,102

[45] Date of Patent: Jan. 19, 1988

[54] BOWLING ALLEY LANE GUARD

[75] Inventor: Donald J. Gibson, London, Canada

[73] Assignee: 638460 Ontario Ltd., London, Canada

[21] Appl. No.: 855,671

[22] Filed: Apr. 25, 1986

[51] Int. Cl.[4] ..... A63D 5/00

[52] U.S. Cl. ..... 273/54 D

[58] Field of Search ..... 273/37, 51, 54 R, 54 D

[56] References Cited

U.S. PATENT DOCUMENTS

| | | | |
|---|---|---|---|
| 972,568 | 10/1910 | Noonan | 273/37 |
| 1,360,661 | 11/1920 | Malone | 273/37 |
| 2,203,458 | 6/1940 | Federer | 273/51 |
| 3,178,181 | 4/1968 | Burnett, Jr. et al. | 273/54 D |

*Primary Examiner*—Anton O. Oechsle

[57] ABSTRACT

A barrier member in the form of a transparent panel is mounted above a bowling alley lane a short distance from the foul line. The lower edge of the panel extends horizontally across the lane at a height slightly greater than the diameter of a bowling ball to be used on the lane. The effect is to require a bowler to roll the ball smoothly onto the lane (in contrast to throwing or lobbing the ball) in order for the ball to pass under the barrier member. The advantages are a reduction in damage to the lane surface from lofted balls, and an improvement in the bowlers' skills.

3 Claims, 1 Drawing Figure

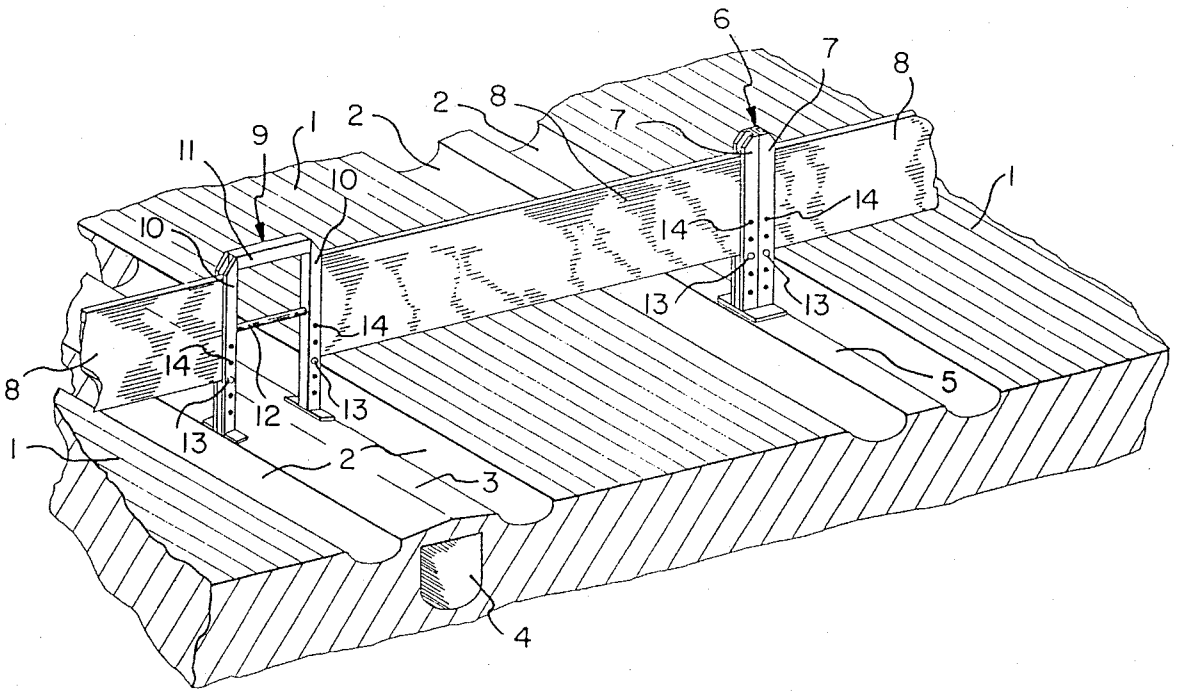
1
2
3
4
5
6
7
8
9
10
11
12
13
14

BOWLING ALLEY LANE GUARD

BACKGROUND TO THE INVENTION

This invention relates to improvements in bowling alleys and more particularly provides a lane guard designed to protect the wooden lane surface from damage.

The purpose of the guard is to force bowlers to "roll" the ball smoothly onto the lane and not to throw or lob the ball at the moment of delivery. Preventing lobbed balls will reduce the cost of maintenance of the surface of the lane bed, and will encourage the bowlers to adopt a better bowling style.

SUMMARY OF THE INVENTION

To this end, the invention provides a barrier member (preferably a transparent, vertically oriented panel) that is mounted at an elevated position along the lane from the foul line, while extending horizontally across the lane at a height slightly greater than the diameter of a bowling ball to be used on the lane. This arrangement requires a bowler to roll the ball smoothly onto the lane in order for it to pass under the barrier member.

This height can be adjustable to accommodate the different ball sizes that are used in the 5 and 10 pin games, as well as to provide for some extra clearance for use by bowlers who have not yet had an opportunity to refine their bowling skills to accommodate to the lane guard.

BRIEF DESCRIPTION OF THE DRAWING

The accompanying drawing shows a perspective view of an embodiment of the invention, illustrating a series of parallel bowling lanes with the usual gutters.

DETAILED DESCRIPTION OF THE PREFERRED EMBODIMENT

Between the gutters 2 of alternate pairs of lanes 1, there is a structural member 3 containing a ball return track 4, and between the intermediate pairs of lanes 1 thee is a solid structural member 5. Upstanding from the member 5 ther is a bracket 6 consisting of a pair of channel members 7 arranged back to back and adapted to support the ends of barrier members in the form of removable panels 8 of a heavy guage, transparent, plastic material. Upstanding from the member 3 there is a bracket 9 consisting of a pair of spaced-apart channel members 10 joined by horizontal braces 11 and 12. The channel members 10 support the other ends of the panels 8.

The panels 8 can be slid vertically in and out of the channel members, being normally maintained in a horizontal orientation by pins 13 that extend through chosen ones of series of holes 14. This arrangement allows the height of the bottom edge of each panel 8 above the alley surface to be adjusted. It has been found that, initially, players have a reluctance to bowl a ball if the guard panels 8 are set too low. For example, when using the size of balls employed in the standard 5-pin Canadian game, the bottom edges of the panels could be set at 6" or 7" above the surface, and then subsequently lowered to a 5" height once the players have become accustomed to the presence of the guards. For the 10-pin game, which uses larger balls, the panels 8 can be moved up to an appropriate height.

A convenient distance to arrange the guards from the foul line would be 15 to 17 feet.

Apart from reducing damage to the lane surfaces. players have found that the invention improves their bowling skills and hence their scores and their general enthusiasm for the game.

While it is preferred that the panels be made of a transparent material, in order to avoid any reduction of visibility, this is not an essential feature of the invention, since the panels are low enough that a player could see over the top of even an opaque panel. Moreover, it is not essential that the barrier members take the form of flat panels. Rods or bars or series of rods or bars could be used instead.

I claim:

1. The combination of a bowling alley lane and a lane guard therefor, comprising a barrier member in the form of a transparent, vertically oriented panel, and means for mounting said barrier member above the lane and along the lane from the foul line to extend horizontally across the lane at a height slightly greater than the diameter of a bowling ball to be used on the lane whereby to require a bowler to roll the ball smoothly onto the lane in order for the ball to pass under the barrier member.

2. The combination of claim 1, wherein the mounting means includes means for adjusting said height.

3. The combination of claim 1, wherein the barrier member is mounted at a distance of about 15 to 17 feet along the lane from the foul line.

* * * * *